United States Patent [19]

Kutami et al.

[11] Patent Number: 4,987,046

[45] Date of Patent: Jan. 22, 1991

[54] ELECTROPHOTOGRAPHIC PHOTOCONDUCTOR AND METHOD FOR THE PREPARATION THEREOF

[75] Inventors: Atsushi Kutami; Yoshikazu Kaneko, both of Numazu, Japan

[73] Assignee: Ricoh Company, Ltd., Tokyo, Japan

[21] Appl. No.: 323,403

[22] Filed: Mar. 14, 1989

[30] Foreign Application Priority Data

Mar. 14, 1988 [JP] Japan ..... 63-61376
May 30, 1988 [JP] Japan ..... 63-134002

[51] Int. Cl.[5] ..... G03G 15/00; G03C 1/74

[52] U.S. Cl. ..... 430/127; 29/132

[58] Field of Search ..... 430/127, 128, 126, 69; 29/132

[56] References Cited

U.S. PATENT DOCUMENTS 3,037,105 5/1962 Kohler ..... 219/8.5

FOREIGN PATENT DOCUMENTS 60-74256 6/1981 Japan ..... 430/127
165149 12/1981 Japan ..... 430/127
107357 6/1984 Japan ..... 430/127

*Primary Examiner*—David Welsh
*Attorney, Agent, or Firm*—Oblon, Spivak, McClelland, Maier & Neustadt

[57] ABSTRACT

An electrophotographic photoconductor is formed of a metallic base drum and a photoconductive layer formed thereon. The base drum is an electroseamed tube prepared by high-frequency welding of a tubular metallic plate or strip. The electroseamed tube may be subjected to extruding or drawing, straightness improving by use of correcting rollers, or machining, grinding, abrasion finish, electro-polishing or anodizing for treatment of its surface.

37 Claims, 1 Drawing Sheet

ELECTROPHOTOGRAPHIC PHOTOCONDUCTOR AND METHOD FOR THE PREPARATION THEREOF

BACKGROUND OF THE INVENTION

1. Field of the Invention

The present invention relates to an electrophotographic photoconductor, and more specifically, an electrophotographic photoconductor having an improved base drum.

2. Background of the Related Art

Conventionally, a base drum of an electrophotographic photoconductor is prepared by forming an aluminum drum by extrusion and machining the surface of this aluminum drum to obtain a mirror surface. This is because the base drum of the electrophotographic photoconductor is required to have high dimensional accuracy and excellent surface smoothness. However, this method of preparing the base drum of the electrophotographic photoconductor has the shortcomings that the manufacturing cost is considerably high and the drum must be thick enough to withstand the surface fabrication process.

Base drums prepared by a drawing and ironing process which do not need extensive fabrication have been proposed in the process disclosed in, for example, Japanese Laid-Open Patent Applications Nos 58-202454, 59-10950, 59-200249 and 61-65256. This process makes it possible to form a thin-walled drum without any necessity of surface machining or other such fabrication. However, this process has the shortcoming that the length of the drum is restricted when the predetermined diameter of the drum is small, although a long drum can be formed when the diameter thereof is increased. More specifically, the length of the drum can be no more than about 3 to 5 times the diameter thereof. The electrophotographic photoconductor is generally required to have a length of 210 mm or more from the viewpoint of its function. To form a 210 mm-long base drum by following the drawing and ironing process, the diameter thereof exceeds at least 40 mm. Therefore it is very difficult to form a 210 mm-long base drum of the electrophotographic photoconductor with a diameter of less than 40 mm by the drawing and ironing process. In addition, the base drum cannot be continuously manufactured by this process, which results in poor productivity.

Metallic drums which are prepared by impact extrusion have been proposed in Japanese Laid-Open Patent Application No. 57-115560. This method has also the shortcomings that the productivity is poor because the metallic drums cannot be continuously manufactured due to batch production, and that the diameter and length of the drum are restricted when the thickness thereof is decreased.

SUMMARY OF THE INVENTION

It is therefore an object of the present invention to provide an electrophotographic photoconductor comprising a metallic base drum and a photoconductive layer formed thereon, which base drum is lightweight and thin-walled and can be continuously manufactured at a low cost without any restriction of the length thereof, and thus free from the above-mentioned shortcomings of the conventional electrophotographic photoconductors.

The above and other objects of the present invention can be attained by a method of producing an electrophotographic photoconductor comprising a metallic base drum and a photoconductive layer formed thereon, which base drum is an electroseamed tube formed by welding a metallic sheet such as a plate or strip in the form of a drum, and by the electrophotographic photoconductor made by this method.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
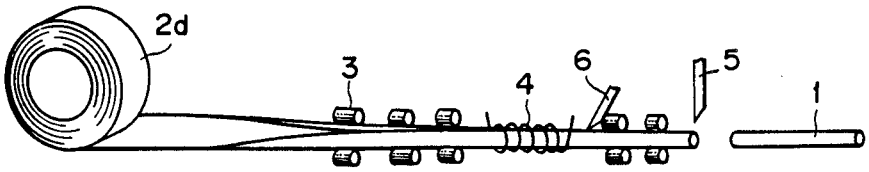
FIG. 1 illustrates the manufacturing process in which a metallic strip is turned into an electroseamed tube.

According to the present invention, the base drum of the electrophotographic photoconductor is an electroseamed tube of a metallic sheet such as a plate or strip, whose seam is obtained by resistance welding. It is preferable that the above electroseamed tube for use in the present invention be prepared by continuous high-frequency welding.

The above-mentioned electroseamed tube is preferably subjected to extruding or drawing subsequent to the welding.

More preferably in the present invention, the above-mentioned electroseamed tube may be subjected to a correcting process, which is one of working processes to correct the shape and improve the dimensional accuracy such as straightness and cylindricity, by allowing the electroseamed tube to pass through correcting rollers. Further, it is preferably subjected to at least one fabrication step such as grinding, machining and abrasion finishing.

Alternatively, the above-mentioned electroseamed tube or worked electroseamed tube may be preferably subjected to a surface treatment such as electropolishing or anodizing.

At the final stage, the preferable surface roughness and dimensional accuracy of the base drum of the electrophotographic photoconductor according to the present invention are as follows:

| | |
|---|---|
| Ten-point mean roughness (Rz) (According to the JIS B 0601) | 2 μm or less |
| Cylindricity (Defined as the difference between the maximum and minimum values of the diameter.) | 0.05 mm or less |
| Straightness | 0.10 mm or less |

-continued

| | |
|---|---|
| Outer diameter tolerance | 0.05 mm or less |
| Wall-thickness non-uniformity | 0.05 mm or less |

In the above, the straightness of the base drum is defined as follows:

When the base drum is placed on a horizontal plane in such a manner that the side of the base drum is in line contact with the horizontal plane over its full length, the difference between the diameter $D_A$ as the base drum measured vertically from the horizontal plane at point A and the corresponding diameter $D_B$ measured in a similar manner at point B which is separated from point A by a distance of 300 mm, that is, the difference of $D_A$-$D_B$ is defined as the straightness of the base drum.

When the cylindricity, straightness and outer diameter tolerance of the base drum are within the above-mentioned range, the electrophotographic photoconductor comprising this base drum can yield uniform images. When the wall-thickness non-uniformity of the base drum is within the above-mentioned range, the runout of the base drum can be minimized after flanging, and accordingly the images can be obtained uniformly and without any abnormality due to flaws and the joint on the surface of the base drum.

The manufacturing process of the electrophotographic photoconductor according to the present invention will now be explained in detail by referring to the attached drawings.

Specific examples of the electroseamed tube material for the photoconductive drum include aluminum, copper, stainless steel, nickel and iron. Among the above, aluminum #1000 to #5000 as defined in the Japanese Industrial Standards (JIS) is the most preferable for the base drum material of the electrophotographic photoconductor.

As shown in FIG. 1, a metallic strip 2*a* is turned into an electroseamed tube 1 in such a manner that both edges of the metallic strip 2*a* are butted to form a drum by a plurality of rollers 3. The joint thereof is then continuously welded by a high-frequency welder 4 at a speed of 1 to 100 m/min. Subsequently, the outer surface and the inside of the welded portion are subjected to machining with a cutting tool 6 to satisfy the predetermined surface profile, and then the tube is cut to a predetermined length by a cutter 5 to form an electroseamed tube 1. High frequency welding methods are taught in U.S. Pat. No. 3,037,105 and in "Forge Welded Tube and Electroseamed Tube, Their Development and History", by K. Mitani and R. Kusakabe, published by Corona-Sha, Tokyo, Japan.

Figure 2:
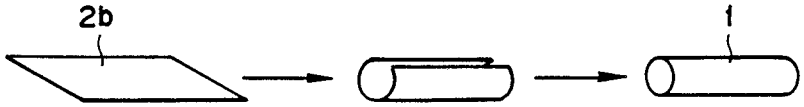
FIG. 2 illustrates the manufacturing process in which a metallic plate is turned into an electroseamed tube.

FIG. 2 shows a metallic plate 2*b* turned into an electroseamed tube 1 by the same process as shown in FIG. 1.

The thus obtained electroseamed tube has high dimensional accuracy with a diameter tolerance of 1/1000 to 10/1000 and a wall-thickness non-uniformity of 1/100 to 10/100. The length of the tube can be adjusted, generally in the range of 210 to 1,000 mm, in accordance with the size of an electrophotographic copying machine employed. The outer diameter of the tube is not restricted either, and can be generally manufactured in the range of 10 to 100mm, more easily in the range of 10 to 40 mm. The thickness of the tube can be decreased to no less than 0.3 mm, and particularly a tube with a thickness of about 0.3 to 2.0 mm can be easily manufactured. The surface smoothness profile of the obtained electroseamed tube varies depending on the type of metallic strips 2*a* and plates 2*b* employed. When metallic strips and plates having a smooth mirror surface are employed, the surface smoothness profile of the obtained electroseamed tube is similarly high.

Figure 3:
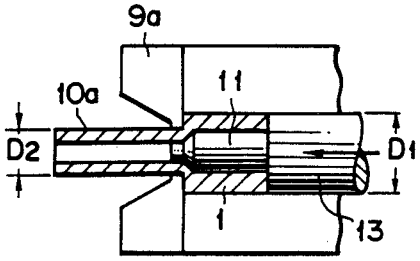
FIG. 3 is a schematic diagram of part of an extruding machine for use in the present invention.
Figure 4:
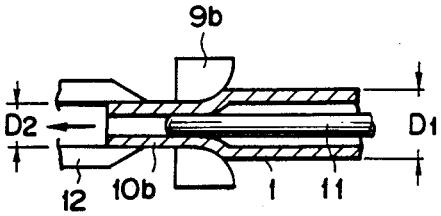
FIG. 4 is a schematic diagram of part of a drawing machine for use in the present invention.

The electroseamed tube 1 for use in the present invention may also be subjected to extrusion or drawing as shown in FIG. 3 and FIG. 4.

When the electroseamed tube 1 for use in the present invention is subjected to extrusion, as shown in FIG. 3, the tube having an outer diameter $D_1$ is extruded from an extrusion die 9*a* by use of an extruding plate 13 enclosing a mandrel 11, so that the extruded tube 10*a* having an outer diameter $D_2$, smaller than $D_1$, is molded by the extrusion die 9*a*. Conversely, when the electroseamed tube 1 for use in the present invention is subjected to drawing, as shown in FIG. 4, the tube having an outer diameter $D_1$ is drawn by a drawing chuck 12, through a die 9*b* surrounding a mandrel 11, so that the drawn tube 10*a* having an outer diameter $D_2$, smaller than $D_1$, is molded by the drawing die 9*b*.

In both of the above-mentioned cases, the extrusion or drawing speed is generally set to 0.01 to 50 m/min.

Examples of the material for the extrusion or drawing dies 9*a* or 9*b* include steel and sintered ceramic. Between a set of successive dies, which have a mirror finish, the tube 1 is passed over a mandrel so as to adjust the internal diameter, straightness and thickness of the tube.

The dimensional accuracy of the electroseamed tube for use in the present invention is improved by the extrusion or drawing process, as shown in the following Table 1.

TABLE 1

| | Before Extrusion or Drawing | After Extrusion or Drawing | Measuring Apparatus |
|---|---|---|---|
| Ten-point mean roughness (Rz) | 3 μm or less | 2 μm or less | Trademark "SURFCOM" made by Tokyo Seimitsu Co., Ltd. |
| Cylindricity | 0.1 mm or less | 0.05 mm or less | Trademark "LASER-MICRO" made by Mitsutoyo |
| Straightness | 0.2 mm or less | 0.1 mm or less | The same as above |
| Outer diameter tolerance | 0.1 mm or less | 0.05 mm or less | The same as above |
| Wall-thickness non-uniformity | 0.1 mm or less | 0.05 mm or less | Micrometer |

The electroseamed tube 1, or the electroseamed tube subjected to extrusion and drawing may then be finished by a correcting roller in order to increase the straightness thereof.

Furthermore, the electroseamed tube may be subjected to conventional surface-treatment such as grinding, machining and abrasive finish. More specifically, the electroseamed tube may be ground by a tool having numerous fine cutting edges such as grindstone, machined by the conventionally known cutting tool, or subjected to mechanical abrasion by an abrasive material or cloth and to chemical abrasion by acids and alkalis.

Alternatively, the electroseamed tube may be surface-treated by electropolishing or anodizing.

The surface profile of the electroseamed tube can be improved by the above-mentioned surface treatment such as machining, grinding, abrasion, electropolishing and anodizing. Any flaw on the surface of the tube is thus removed therefrom and the surface can be kept smooth, so that the presence of air bubbles between the drum surface and the photoconductive layer can be eliminated and abnormal images due to the poor surface profile of the drum can be prevented.

Electropolishing can be carried out by the conventional methods. The electroseamed tube is subjected to electrolysis, such as anodizing, in an oxidized electrolyte under the predetermined conditions. As the electrolyte for use in the present invention, glacial acetic acid and phosphoric acid can be employed with the addition of acids having a strong oxidizing force such as perchloric acid and chromic acid.

Anodizing can be conducted in the electrolyte under the general conditions. Preferable examples of the electrolyte are sulphuric acid, oxalic acid and phosphoric acid because the film produced on the surface of the electroseamed tube is colorless when the above electrolyte is employed. Among these, a sulphuric acid solution is the most appropriate electrolyte in the present invention since the film produced on the surface of the electroseamed tube can come into very close contact with the photoconductive layer formed thereon.

When a sulphuric acid solution is employed as the anodizing electrolyte, it is preferable that the concentration of sulphuric acid be in the range of 10 to 70% wt. %, more preferably in the range of 10 to 20 wt. %. The electrolysis temperature used can be freely chosen within the range of about 10° to 50° C. and the electrolysis time can also be adjusted in the range of about 1 to 120 minutes.

When a phosphoric acid solution is employed as the anodizing electrolyte, it is preferable that the concentration of phosphoric acid be in the range of 5 to 30% (by weight). The electrolysis temperature used can be freely chosen within the range of about 10° to 50° C. and the electrolysis time can also be adjusted in the range of about 1 to 60 minutes.

When an oxalic acid solution is employed as the anodizing electrolyte, it is preferable that the concentration of oxalic acid be in the range of 1 to 5% (by weight). The electrolysis temperature used can be freely chosen within the range of about 10° to 30° C. and the electrolysis time can also be adjusted in the range of about 1 to 60 minutes.

Electrolysis may be carried out by a constant current anodizing process or a constant voltage anodizing process in the present invention.

It is preferable that the thickness of the produced anodic oxide film be in the range of 0.01 to 10 μm, more preferably in the range of 0.1 to 5 μm.

Figure 5A:
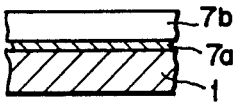
FIG. 5A is an enlarged schematic sectional view of an embodiment of an organic electrophotographic photoconductor according to the present invention.
Figure 5B:
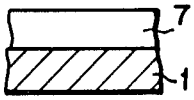
FIG. 5B is an enlarged schematic sectional view of an embodiment of an inorganic electrophotographic photoconductor.

After the thus obtained electroseamed tube 1 is washed by water or an organic solvent such as methanol, ethanol, acetone, methyl ethyl ketone and trichlene, an organic photoconductive layer comprising a charge generation layer *7a* and a charge transport layer *7b*, which are conventionally known, is formed on the tube 1, as shown in FIG. 5A. Alternatively, a conventional inorganic photoconductive layer 7 made of materials such as zinc oxide, selenium, and cadmium sulfide is formed on the tube 1, as shown in FIG. 5B.

From the viewpoint of electrostatic characteristics, a resin layer and a whitening-agent-containing resin layer may be interposed between the photoconductive layer and the base tube as an undercoat layer when necessary. An overcoat layer may be formed on the photoconductive layer for the purpose of protecting the photoconductive layer.

The above-mentioned photoconductive layer can be provided on the electroseamed tube by the conventional methods such as dip coating, spray coating and vapor deposition.

The above-mentioned organic photoconductive layer will now be explained in detail.

Specific examples of the charge generating material for use in the charge generation layer are as follows: organic pigments, such as C.I. Pigment Blue 25 (C.I. 21180), C.I. Pigment Red 41 (C.I. 21200), C.I. Acid Red 52 (C.I. 45100), and C.I. Basic Red 3 (C.I. 45210); a phthalocyanine pigment, an azulenium salt pigment, a squaric pigment, an azo pigment having a carbazole skeleton (Japanese Laid-Open Patent Application 53-95033), an azo pigment having a stilstilbene skeleton (Japanese Laid-Open Patent Application 53-138229), an azo pigment having a triphenylamine skeleton (Japanese Laid-Open Patent Application 53-132547), an azo pigment having a dibenzothiophene skeleton (Japanese Laid-Open Patent Application 54-21728), an azo pigment having an oxadiazole skeleton (Japanese Laid-Open Patent Application 54-12742), an azo pigment having a fluorenone skeleton (Japanese Laid-Open Patent Application 54-22834), an azo pigment having a bisstilbene skeleton (Japanese Laid-Open Patent Application 54-17733), an azo pigment having a distyryl oxadiazole skeleton (Japanese Laid-Open Patent Application 54-2129), and an azo pigment having a distyryl carbazole skeleton (Japanese Laid-Open Patent Application 54-17734); a triazo pigment having a carbazole skeleton (Japanese Laid-Open Patent Applications 57-195767 and 57-195768), a phthalocyanine pigment such as C.I. Pigment Blue 16 (C.I. 74100); indigo pigments such as C.I. Vat Brown 5 (C.I. 73410) and C.I. Vat Dye (C.I. 73030); and perylene pigments such as Algol Scarlet B and Indanthrene Scarlet R (made by Bayer Co., Ltd.).

It is preferable that the thickness of the charge generation layer be in the range of about 0.05 to 2 μm, more preferably in the range of 0.1 to 1 μm.

A mixture of the above-mentioned charge generating material and a binder resin is dissolved or dispersed in an appropriate solvent such as methanol, ethanol, acetone, methyl ethyl ketone, cyclohexanone, cyclohexane, N,N-dimethylformamide, tetrahydrofuran, dioxane, dichloroethylene, benzene, toluene or dichlorobenzene. This dispersion is coated on the base drum and then dried, so that a charge generation layer can be formed on the base drum.

Specific examples of the above-mentioned solvent for use in the present invention are benzene, toluene, xylene, methylene chloride, dichloroethane, monochlorobenzene, dichlorobenzene, ethyl acetate, butyl acetate, methyl ethyl ketone, dioxane, tetrahydrofuran, cyclohexanone, methyl cellosolve and ethyl cellosolve. These solvents can be used alone or in combination.

A mixture of the charge transporting material and the binder resin is dissolved or dispersed in the same solvent as employed in the preparation for the charge generation layer. This dispersion is coated on the aforementioned charge generation layer and then dried, so that a charge transport layer can be formed on the charge generation layer. A plasticizer and a leveling agent may be added to the above dispersion when necessary.

As the charge transporting material, electron doners such as poly-N-vinylcarbazole, derivatives thereof, polycarbazolin ethyl glutamate, derivatives thereof, pyreneformaldehyde condensation products, derivatives thereof, polyvinyl pyrene, polyvinyl phenanthrene, oxazole derivatives, oxadiazole derivatives, imidazole derivatives, triphenylamine derivatives, 9-(p-diethylaminostyryl)-anthracene, 1,1-bis(4-dibenzylaminophenyl)propane, styrylanthracene, styrylpyrazoline, phenylhydrazone and α-phenyl stilbene derivatives may be employed.

Examples of the above-mentioned binder resin for the charge generation layer and the charge transport layer are thermoplastic or thermosetting resins such as polystyrene, styrene—acrylonitrile copolymer, styrene—butadiene copolymer, styrene—maleic anhydride copolymer, polyester, polyvinyl chloride, vinyl chloride—vinyl acetate copolymer, polyvinyl acetate, polyvinylidene chloride, polyacrylate resin, phenoxy resin, polycarbonate, cellulose acetate resin, ethylcellulose resin, polyvinyl butyral, polyvinyl—formal, polyvinyl toluene, poly-N-vinylcarbazole, acrylic resin, silicone resin, epoxy resin, melamine resin, urethane resin, phenolic resin, and alkyd resin.

Examples of the solvent for the above-mentioned charge transporting materials are tetrahydrofuran, dioxane, toluene, monochlorobenzene, dichloroethane and methylene chloride.

It is preferable that the thickness of the charge transport layer be in the range of about 5 μm to 100 μm.

In case where the single-layered type photoconductive layer is formed as shown in FIG. 5B, the single-layered type photoconductive layer comprises the above-mentioned charge generating material, charge transporting material and a binder resin.

The present invention will now be explained in detail by referring to the following examples, which are given for illustration of the invention, and are not intended to be limiting thereof.

EXAMPLE 1

An aluminum strip 2*a* (JIS #1000) having a thickness of 0.8 mm was formed in the shape of a drum was continuously welded by a high-frequency welder 4 via a plurality of rollers 3 which pressed the aluminum strip to bend it into a drum at a speed of 50 to 60 m/min, as shown in FIG. 1. The joined portion of the aluminum drum was continuously welded by a high frequency welder 4 as described in U.S. Pat. No. 3,037,105, and at the same time, the welded portion was machined by a cutting tool 6 made of a super hard alloy and cut by a cutter 5 such as a buzz saw, so that an aluminum electroseamed tube 1 having an outer diameter of 30 mm and a length of 260 mm was prepared.

The following components were dispersed and dissolved in a mixed solvent of cyclohexanone and methyl ethyl ketone with a mixing ratio of 1 : 1, so that a charge generation layer coating liquid was obtained.

| | Amount |
|---|---|
| Charge generating material [Compound 1 having the following formula (1)] | 22 g |

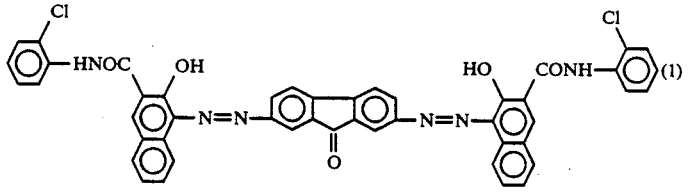

| | |
|---|---|
| 5% cyclohexanone solution of a phenoxy resin (Trademark "PKHH" made by Union Carbide Japan K.K.) | 176 g |
| Cyclohexanone | 200 g |

This charge generation layer coating liquid was coated by spray coating on the above-prepared aluminum electroseamed tube, so that a charge generation layer 7*a* was formed on the aluminum electroseamed tube with a thickness of 0.2 μm when dried at room temperature.

Then the following components were mixed and dissolved, so that a charge transport layer coating liquid was prepared.

| | Amount |
|---|---|
| Charge transporting material [Compound 2 having the following formula (2)] | 250 g |

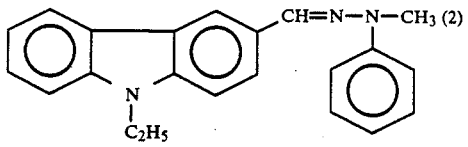

| | |
|---|---|
| Polycarbonate (Trademark "C-1400" made by Teijin Limited.) | 280 g |
| Silicone oil (Trademark "KF-50" made by Shin-Etsu Chemical Co., Ltd.) | 0.5 g |
| Tetrahydrofuran | 1,700 g |

The thus prepared charge transport layer coating liquid was coated on the aforementioned charge generation layer by dip coating and dried at 130° C. for 30 minutes, so that a charge transport layer 7*b* with a thickness of 20 μm was formed on the charge generation layer; thus, an electrophotographic photoconductor No. 1 according to the present invention was prepared.

The electrophotographic photoconductor No. 1 was incorporated in a commercially available electrophotographic copying machine. In this copying machine, the photoconductor was charged in the dark under application of −6 kV of corona charge by the scorotron method, the thus uniformly charged photoconductor was exposed to original light images by a halogen lamp to form latent electrostatic images thereon, the thus formed latent electrostatic images were developed by a dry-type toner to form visible toner images, the thus formed visible toner images were transferred to a sheet of plain paper, and then a cleaning process was performed on the drum by an urethane rubber blade. When the above electrophotographic photoconductor No. 1 was subjected to the image-formation test, clear images were obtained free from the deposition of the toner particles on the background.

EXAMPLE 2

A stainless steel plate 2b having a thickness of 0.5 mm was formed in the shape of a drum by the same method as in Example 1, and the joined portion of the aluminum drum was continuously welded by a high-frequency welder 4 at a speed of 10 m/min, as shown in FIGS. 1 and 2, so that a stainless steel electroseamed tube having an outer diameter of 30 mm and a length of 260 mm was prepared.

The same procedures in the preparation for the charge generation layer and the charge transport layer as employed in Example 1 were repeated, whereby an electrophotographic photoconductor No. 2 according to the present invention was prepared. As a result of the same image-formation test as employed in Example 1, clear images were obtained.

EXAMPLE 3

An aluminum strip 2a (JIS #1100) having a thickness of 1.2 mm was formed in the shape of a drum via a plurality of rollers 3 at a speed of 50 to 60 m/min, by the same method as in Example 1 as shown in FIG. 1. The joined portion of the aluminum drum was continuously welded by a high frequency welder 4, and at the same time, the welded portion was machined by a cutting tool 6 made of a super hard alloy and cut by a cutter 5 such as a buzz saw, so that an aluminum electroseamed tube 1 having an outer diameter of 34 mm was formed.

The thus prepared aluminum electroseamed tube 1 was placed in the drum-like extrusion die 9a which is made of a super hard alloy, as shown in FIG. 3, and was extruded by oil pressure at a speed of approximately 50 mm/sec the extruded electroseamed tube 10a having an outer diameter of 30 mm and a thickness of 1 mm was obtained without any flaws and joints.

The dimensional accuracy of this extruded electroseamed tube was as follows:

TABLE 2

| Item | Value | Measuring Apparatus |
|---|---|---|
| Ten-point mean roughness (Rz) | 0.5 to 0.8 μm | Trademark "SURFCOM" made by Tokyo Seimitsu Co., Ltd. |
| Cylindricity | 0.03 to 0.04 mm | Trademark "LASER-MICRO" made by Mitsutoyo |
| Straightness | 0.03 to 0.05 mm | The same as above |
| Outer diameter tolerance | 0.03 to 0.05 mm | The same as above |
| Wall-thickness non-uniformity | 0.01 to 0.03 mm | Micrometer |

A charge generation layer coating dispersion in which a bisazo pigment having the following formula (1) was dispersed in a butyral resin with a weight ratio of 2.5 to 1 was coated on the above extruded electroseamed tube by dip coating, so that a charge generation layer having a thickness of 0.3 μm was formed on the electroseamed tube.

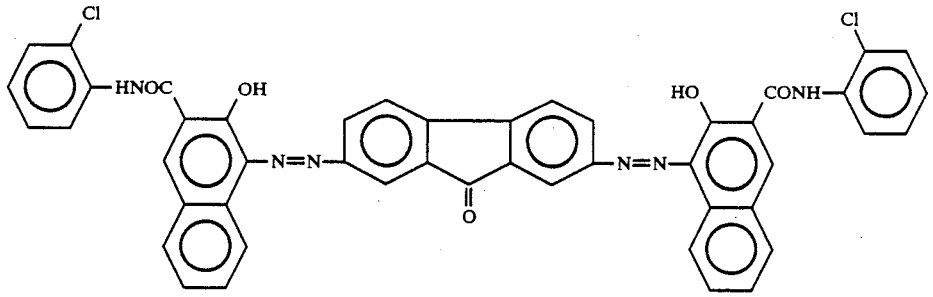

(1)

A charge transport layer coating dispersion in which a styryl compound having the following formula (3) was dispersed in a polycarbonate resin with a weight ratio of 9 to 10 was coated on the aforementioned charge generation layer by dip coating, so that a charge transport layer having a thickness of 20 μm was formed on the charge generation layer; thus an electrophotographic photoconductor No. 3 according to the present invention was prepared.

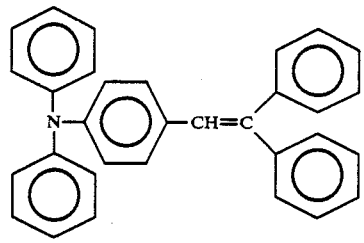

(3)

The thus prepared electrophotographic photoconductor No. 3 was incorporated in a commercially available copying machine (Trademark "FC-3" made by Canon Inc.) and subjected to the image-formation test for image evaluation. As a result, excellent images were obtained.

EXAMPLE 4

An aluminum strip 2a (JIS #5052) having a thickness of 1.2 mm was formed in the shape of a drum was continuously welded by a high-frequency welder 4 via a plurality of rollers 3 at a speed of 50 to 60 m/min, by the same method as in Example 1, as shown in FIG. 1. The joined portion of the aluminum drum was continuously welded by a high-frequency welder 4, and at the same time, the welded portion was machined by a cutting tool 6 made of a super hard alloy and cut by a cutter 5 such as a buzz saw, so that an aluminum electroseamed tube 1 having an outer diameter of 34 mm was prepared.

The thus obtained aluminum electroseamed tube 1 was processed in drawing dies such as the drawing die **9*b* which is made of a super hard alloy and is in the shape of a drum as shown in FIG. 4, and was drawn at a speed of approximately 50 mm/sec, so that the drawn electroseamed tube 10*b*** having an outer diameter of 30 mm and a thickness of 1 mm was obtained.

The dimensional accuracy of this drawn electroseamed tube was as follows:

TABLE 3

| Item | Value | Measuring Apparatus |
|---|---|---|
| Ten-point mean roughness (Rz) | 0.3 to 0.7 μm | Trademark "SURFCOM" made by Tokyo Seimitsu Co., Ltd. |
| Cylindricity | 0.02 to 0.03 mm | Trademark "LASER-MICRO" made by Mitsutoyo |
| Straightness | 0.02 to 0.04 mm | The same as above |
| Outer diameter tolerance | 0.01 to 0.04 mm | The same as above |
| Wall-thickness | 0.01 to 0.03 mm | Micrometer |

The same procedures in the preparation for the photoconductive layer as employed in Example 3 were repeated, whereby an electrophotographic photoconductor No. 4 according to the present invention was produced. As a result of the same image-formation test as employed in Example 3, images were uniformly obtained without any abnormality due to flaws and joints on the surface of the electroseamed tube.

EXAMPLE 5

An aluminum strip **2*a* (JIS #1100) having a thickness of 1.0 mm was formed in the shape of a drum was continuously welded by a high-frequency welder 4 via a plurality of rollers 3 at a speed of 50 to 60 m/min, as shown in FIG. 1. The joined portion of the aluminum drum was continuously welded by a high-frequency welder 4, and at the same time, the welded portion was machined by a cutting tool 6 made of a super hard alloy and cut by a cutter 5 such as a buzz saw, so that an aluminum electroseamed tube 1** having an outer diameter of 34 mm was formed.

The thus prepared aluminum electroseamed tube 1 was processed in drawing dies such as the drawing die **9*b* which is made of a super hard alloy and is in the shape of a drum as shown in FIG. 4, and then finished by a correcting roller which is pressed on the drawn electroseamed tube, so that the drawn electroseamed tube 10*b*** having an outer diameter of 30 mm and a length of 260 mm was obtained.

The thus obtained electroseamed tube was degreased by use of a weak alkaline solution and subjected to anodizing with constant current in 15% sulphuric acid solution serving as an electrolyte for 5 minutes under the conditions that the temperature of the electrolyte was kept at 20° C. and a current density was 1.3 A/cm$^2$.

The anodic oxide film produced on the surface of the electroseamed tube was then washed and dried.

The same procedures in the preparation for the photoconductive layer as employed in Example 3 were repeated, whereby an electrophotographic photoconductor No. 5 according to the present invention was produced. As a result of the same image-formation test as employed in Example 3, images were uniformly obtained without any abnormality due to flaws and joints on the surface of the electroseamed tube.

EXAMPLE 6

An aluminum strip **2*a* (JIS #1100) having a thickness of 0.8 mm was formed in the shape of a drum via a plurality of rollers 3 at a speed of 50 to 60 m/min, as shown in FIG. 1. The joined portion of the aluminum drum was continuously welded by a high-frequency welder 4, and at the same time, the welded portion was machined by a cutting tool 6 made of a super hard alloy and cut by a cutter 5 such as a buzz saw, so that an aluminum electroseamed tube 1** having an outer diameter of 34 mm was prepared.

The thus prepared aluminum electroseamed tube 1 was placed in the drawing die **9*b* which is made of a super hard alloy and was in the shape of drum as shown in FIG. 4, and then finished by a correcting roller which was pressed on the drawn electroseamed tube by the same method as in Example 5, so that the electroseamed tube 10*b*** having an outer diameter of 30 mm and a length of 260 mm was obtained.

The thus obtained electroseamed tube was washed by use of an alcoholic solution and subjected to anodizing with constant voltage in 10% phosphoric acid solution serving as an electrolyte for 20 minutes under the conditions that the temperature of the electrolyte was kept at 30° C. and the applied voltage was 20 V.

The anodic oxide film produced on the surface of the electroseamed tube was then washed and dried.

The same procedures in the preparation for the photoconductive layer as employed in Example 3 were repeated, whereby an electrophotographic photoconductor No. 6 according to the present invention was produced. As a result of the same image-formation test as employed in Example 3, excellent images were obtained.

EXAMPLE 7

An aluminum strip **2*a* (JIS #1100) having a thickness of 1 mm was formed in the shape of a drum via a plurality of rollers 3 at a speed of 50 to 60 m/min, as shown in FIG. 1. The joined potion of the aluminum drum was continuously welded by a high-frequency welder 4, and at the same time, the welded portion was machined by a cutting tool 6 made of a super hard alloy and cut by a cutter 5 such as a buzz saw, so that an aluminum electroseamed tube 1** having an outer diameter of 40 mm and a length of 250 mm was prepared.

The thus prepared electroseamed tube was subjected to electropolishing in a mixed solution of phosphoric acid, sulfuric acid and chromic acid, washed and then dried.

The same procedures in the preparation for the charge generation layer and the charge transport layer as employed in Example 1 were repeated, whereby an electrophotographic photoconductor No. 7 according to the present invention was produced. As a result of the same image-formation test as employed in Example 1, clear images were obtained.

EXAMPLE 8

An aluminum plate 2*b* (JIS #5052) having a thickness of 1.0 mm was formed in the shape of a drum via a plurality of rollers 3 at a speed of 50 to 60 m/min, as shown in FIG. 2. The joined portion of the aluminum drum was continuously welded by a high-frequency welder 4, and at the same time, the welded portion was machined by a cutting tool 6 made of a super hard alloy and cut by a cutter 5 such as a buzz saw, so that an aluminum electroseamed tube having an outer diameter of 30 mm was formed.

The thus formed aluminum electroseamed tube was finished by a correcting roller by the same method as in Example 5 until the straightness thereof reached 0.03 mm or less.

The above electroseamed tube was subjected to vapor degreasing using trichloroethylene.

A charge generation layer coating dispersion in which a bisazo pigment having the following formula (1) was dispersed in a butyral resin with a weight ratio of 2.5 to 1 was coated on the above degreased electroseamed tube by dip coating, so that a charge generation layer having a thickness of 0.1 to 0.5 μm was formed on the electroseamed tube.

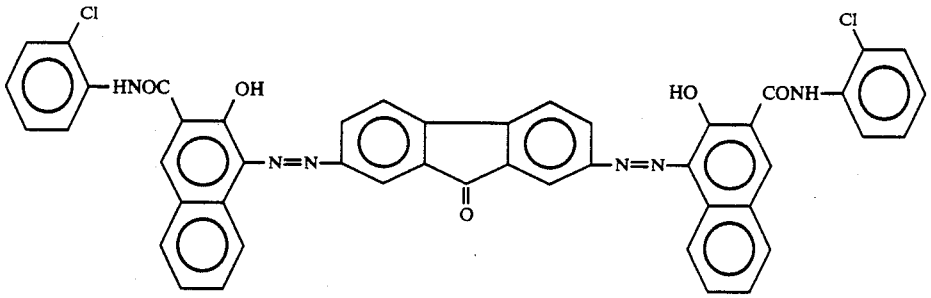

(1)

A charge transport layer coating dispersion in which a styryl compound having the following formula (3) was dispersed in a polycarbonate resin with a weight ratio of 9 to 10 was coated on the aforementioned charge generation layer by dip coating, so that a charge transport layer having a thickness of 20 to 22 μm was formed on the charge generation layer; thus an electrophotographic photoconductor No. 8 according to the present invention was produced.

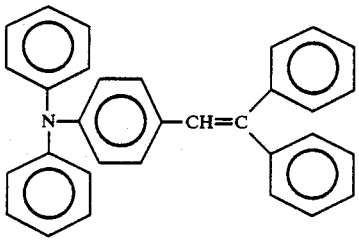

(3)

The thus prepared electrophotographic photoconductor No. 8 was incorporated in a commercially available copying machine (Trademark "FC-3" made by Canon Inc.) and subjected to an image-formation test for image evaluation. As a result, excellent images were obtained.

EXAMPLE 9

An aluminum plate 2*b* (JIS #1100) having a thickness of 0.8 mm was formed in the shape of a drum via a plurality of rollers 3 at a speed of 50 to 60 m/min, as shown in FIG. 2. The joined portion of the aluminum drum was continuously welded by a high-frequency welder 4, and at the same time, the welded portion was machined by a cutting tool 6 made of a super hard alloy and cut by a cutter 5 such as a buzz saw, so that an aluminum electroseamed tube having an outer diameter of 30 mm was formed.

The thus formed electroseamed tube was subjected to grinding by use of a grindstone, so that the electroseamed tube with a maximum height (Rmax) of 1 μm or less and a tenpoint mean roughness (Rz) of 0.6 μm or less (in accordance with the JIS B 0601) was obtained.

The above electroseamed tube was subjected to vapor degreasing using trichloroethylene.

The same procedures in the preparation for the charge generation layer and the charge transport layer as employed in Example 8 were repeated, whereby an electrophotographic photoconductor No. 9 according to the present invention was prepared. As a result of the same image-formation test as employed in Example 8, clear images were obtained.

According to the present invention, as previously mentioned, the lightweight base drum of the electrophotographic photoconductor can be continuously manufactured at a low cost. The thus manufactured base drum is not restricted with respect to its length, outer diameter and thickness, and the dimensional accuracy of the drum is remarkably high. Accordingly, the above-mentioned electrophotographic photoconductor can yield clear images uniformly without any abnormality due to the flaw and joint on the surface of the photoconductive drum.

What is claimed is:

1. A method for producing an electrophotographic photoconductor, comprising the steps of:

forming a metallic sheet in the form of a tube having a seam;

welding the seam of said tube by resistance welding to form an electroseamed tube; and coating a photoconductive layer on said electroseamed tube.

2. The method as claimed in claim 1, wherein said step of welding is performed by continuous high-frequency welding.

3. The method as claimed in claim 1, further comprising a step of extruding said base drum subsequent to said welding step and prior to said coating step.

4. The method as claimed in claim 1, further comprising a step of drawing said base drum subsequent to said welding step and prior to said coating step.

5. The method as claimed in claim 1, further comprising a step of improving the straightness of said base drum by use of a correcting roller.

6. The method as claimed in claim 3, further comprising a step of improving the straightness of said base drum by use of a correcting roller.

7. The method as claimed in claim 4, further comprising a step of improving the straightness of said base drum by use of a correcting roller.

8. The method as claimed in claim 1, further comprising a step of treating the surface of said base drum, said treating step being selected from the group consisting of the steps of machining finishing, grinding finishing, and abrasion finishing.

9. The method as claimed in claim 2, further comprising a step of treating the surface of said base drum, said treating step being selected from the group consisting of the steps of machining finishing, grinding finishing, and abrasion finishing.

10. The method as claimed in claim 3, further comprising a step of treating the surface of said base drum, said treating step being selected form the group consisting of the steps of machining finishing, grinding finishing, and abrasion finishing.

11. The method as claimed in claim 4, wherein said method further comprising a step of treating the surface of said base drum, said treating step being selected from the group consisting of the steps of machining finishing, grinding finishing, and abrasion finishing.

12. The method as claimed in claim 5, wherein said method further comprising a step of treating the surface of said base drum, said treating step being selected from the group consisting of the steps of machining finishing, grinding finishing, and abrasion finishing.

13. The method as claimed in claim 6, wherein said method further comprising a step of treating the surface of said base drum, said treating step being selected from the group consisting of the step so machining finishing, grinding finishing, and abrasion finishing.

14. The method as claimed in claim 7, wherein said method further comprising a step of treating the surface of said base drum, said treating step being selected from the group consisting of the steps of machining finishing, grinding finishing, and abrasion finishing.

15. The method as claimed in claim 1, further comprising a step of treating the surface of said base drum, said treating step being selected from the group consisting of the steps of electropolishing and anodizing.

16. The method as claimed in claim 2, further comprising a step of treating the surface of said base drum, said treating step being selected from the group consisting of the steps of electropolishing and anodizing.

17. The method as claimed in claim 3, further comprising a step of treating the surface of said base drum, said treating step being selected from the group consisting of the steps of electropolishing and anodizing.

18. The method as claimed in claim 4, further comprising a step of treating the surface of said base drum, said treating step being selected from the group consisting of the steps of electropolishing and anodizing.

19. The method as claimed in claim 5, further comprising a step of treating the surface of said base drum, said treating step being selected from the group consisting of the steps of electropolishing and anodizing.

20. The method as claimed in claim 6, further comprising a step of treating the surface of said base drum, said treating step being selected from the group consisting of the steps of electropolishing and anodizing.

21. The method as claimed in claim 7, further comprising a step of treating the surface of said base drum, said treating step being selected from the group consisting of the steps of electropolishing and anodizing.

22. An electrographic photoconductor produced by the method of claim 1.

23. An electrographic photoconductor produced by the method of claim 2.

24. An electrographic photoconductor produced by the method of claim 3.

25. An electrographic photoconductor produced by the method of claim 4.

26. An electrographic photoconductor produced by the method of claim 8.

27. An electrographic photoconductor produced by the method of claim 15.

28. The electrophotographic photoconductor as claimed in claim 22, wherein said electroseamed tube has a ten-point mean surface roughness (Rz) no greater than 2 μm, a cylindricity no greater than 0.05 mm, a straightness no greater than 0.10 mm, an outer diameter tolerance no greater than 0.05 mm and a wall-thickness non-uniformity no greater than 0.05 mm.

29. The electrophotographic photoconductor as claimed in claim 22, wherein said electroseamed tube has a thickness of 0.3 to 2 mm, an outer diameter of 10 to 100 mm and a length of 210 to 1,000 mm.

30. The electrophotographic photoconductor as claimed in claim 29, wherein said electroseamed tube has a thickness of 0.3 to 2 mm, an outer diameter of 10 to 40 mm and a length of 210 to 1,000 mm.

31. An electrophotographic photoconductor comprising an electroseamed tube coated with a photoconductive layer, the electroseamed tube having a ten point mean surface roughness (Rz) no greater than 2 μm, a cylindricity no greater than 0.05 mm, a straightness no greater than 10 mm, an outer diameter tolerance no greater than 0.05 mm, a wall thickness no-uniformity no greater than 0.05 mm, an outer diameter of 10 to 100 mm, a thickness of 0.03 to 2 mm and a length of 210 to 1,000 mm.

32. The electrophotographic photoconductor of claim 31 wherein said electroseamed tube is formed by a method comprising the steps of:

forming a metallic sheet in the form of tube;

welding the seam of the tube by continuous high frequency resistance welding to form the electroseamed tube;

performing one of an extruding and drawing step on said electroseamed tube; and treating the surface of said base drum in a treating step selected from the group consisting of machine finishing, grinding finishing, abrasion finishing, electropolishing and anodizing.

33. The electrophotographic photoconductor according to claim 32, wherein said welding step of said forming method is performed at between 1 and 100 m/min.

34. The electrophotographic photoconductor according to claim 32, wherein said forming method including the step of machining a welded portion of said electroseamed tube with a cutting tool so as to achieve a desired surface profile.

35. An electrophotographic photoconductor comprising:

a cylindrical metallic tube member having a longitudinal seam; and a photoconductive layer coated on said tube member.

36. The electrophotographic photoconductor according to claim 35 wherein said seam is a welded seam.

37. The electrophotographic photoconductor according to claim 35 wherein said tube member has a length of at least 210 mm and a diameter less than 40 mm.

* * * * *

UNITED STATES PATENT AND TRADEMARK OFFICE

CERTIFICATE OF CORRECTION

PATENT NO. : 4,987,046

DATED : JANUARY 22, 1991

INVENTOR(S) : KUTAMI ET AL

It is certified that error appears in the above-identified patent and that said Letters Patent is hereby corrected as shown below:

Column 3, lines 50-54, please delete "High frequency welding methods are taught in U.S. Pat. No. 3,037,105 and in "Forge Welded Tube and Electroseamed Tube, Their Development and History", by K. Mitani and R. Kusakabe, published by Corona-Sha, Tokyo, Japan.";

Columns 7-8, please delete entire paragraph "An aluminum strip 2a ... and a length of 260 mm was prepared." and insert --An aluminum strip having a thickness of 0.8 mm and in the form of a drum was continuously welded by a high-frequency welder 4 via a plurality of rollers 3 at a speed of 50 to 60 m/min, as shown in Fig. 1. The welded portion was machined by a cutting tool 6 and cut by a cutter 5, so that an aluminum electroseamed tube 1 having an outer diameter of 30 mm and a length of 260 mm was prepared.--;

Column 9, lines 18-20, please delete "was formed in the shape of a drum by the same method as in Example 1, and the joined portion of the aluminum drum" and insert --and in the form of a drum--.

Column 9, lines 60-66, please delete entire paragraph "The thus prepared aluminum electroseamed tube 1 ... obtained without any flaws and joints." and insert -- The thus prepared aluminum electroseamed tube 1 was placed in the extrusion dies 9a as shown in Fig. 3, so that the extruded electroseamed tube 10a having an outer diameter of 30 mm and a thickness of 1 mm was obtained without any flaws and joints.--;

UNITED STATES PATENT AND TRADEMARK OFFICE

CERTIFICATE OF CORRECTION

PATENT NO. : 4,987,046

DATED : JANUARY 22, 1991

INVENTOR(S) : KUTAMI ET AL

It is certified that error appears in the above-identified patent and that said Letters Patent is hereby corrected as shown below:

Column 10-11, lines 66-8, please delete entire paragraph "An aluminum strip 2a (JIS #5052) having a thickness ... tube 1 having an outer diameter of 34 mm was prepared." and insert --An aluminum strip 2a (JIS #5052) having a thickness of 1.2 mm and in the form of a drum was continuously welded by a high-frequency welder 4 via a plurality of rollers 3 at a speed of 50 to 60 m/min, as shown in Fig. 1. The welded portion was machined by a cutting tool 6 and cut by a cutter 5, so that an aluminum electroseamed tube 1 having an outer diameter of 34 mm was prepared.--;

Column 11, line 30, under "Wall-thickness" insert --non-uniformity--;

Column 11, lines 42-52, please delete entire paragraph "An aluminum strip 2a (JIS #1100) having a thickness ... diameter of 34 mm was formed." and insert --An aluminum strip 2a (JIS #1100) having a thickness of 1.0 mm and in the form of a drum was continuously welded by a high-frequency welder 4 via a plurality of rollers 3 at a speed of 50 to 60 m/min, as shown in Fig. 1. The welded portion was machined by a cutting tool 6 and cut by a cutter 5, so that an aluminum electroseamed tube 1 having an outer diameter of 34 mm was formed.--;

Column 11, lines 53-60, please delete entire paragraph "The thus prepared aluminum electroseamed tube 1 ... length of 260 mm was obtained." and insert --The thus prepared aluminum electroseamed tube 1 was processed in drawing dies such as the It is certified that error appears in the above-identified patent and that said Letters Patent is hereby corrected as shown below:

drawing die 9b as shown in Fig. 4, and then finished by a correcting roller, so that the drawn electroseamed tube 10b having an outer diameter of 30 mm and a length of 260 mm was obtained.--;

Column 12, lines 12-21, please delete entire paragraph "An aluminum strip 2a (JIS #1100) having a thickness ... diameter of 34 mm was prepared." and insert --An aluminum strip 2a (JIS #1100) having a thickness of 0.8 mm and in the form of a drum was continuously welded by a high frequency welder 4 via a plurality of rollers 3 at a speed of 50 to 60 m/min, as shown in Fig. 1. The welded portion was machined by a cutting tool 6 and cut by a cutter 5, so that an aluminum electroseamed tube 1 having an outer diameter of 34 mm was prepared.--;

Column 12, lines 22-29, please delete entire paragraph "The thus prepared aluminum electroseamed tube 1 ... length of 260 mm was obtained." and insert --The thus prepared aluminum electroseamed tube 1 was placed in the drawing dies 9b as shown in Fig. 4, and then finished by a correcting roller, so that the drawn electroseamed tube 10b having an outer diameter of 30 mm and a length of 260 mm was obtained.--;

Column 12, lines 48-57, please delete entire paragraph "An aluminum strip 2a (JIS #1100) having a thickness ... and a length of 250 mm was prepared." and insert --An aluminum strip 2a (JIS #1100) having a thickness of 1 mm and in the form of a drum was continuously welded by a high-frequency welder 4

It is certified that error appears in the above-identified patent and that said Letters Patent is hereby corrected as shown below:

via a plurality of rollers 3 at a speed of 50 to 60 m/min., as shown in Fig. 1. The welded portion was machined by a cutting tool 6 and cut by a cutter 5, so that an aluminum electroseamed tube having an outer diameter of 40 mm and length of 250 mm was prepared.--;

Column 13, lines 13-16, please delete entire paragraph "The thus formed aluminum electroseamed tube was ... mm or less." and insert --The thus formed aluminum electroseamed tube was finished by a correcting roller until the straightness thereof reached 0.03 mm or less.--;

Column 13, between lines 16 and 17, please insert paragraph --Furthermore, the above electroseamed tube was subjected to finishing by machining, so that an electroseamed tube with a maximum surface roughness (Rmax) of 1 to 2 μm and a ten-point mean roughness (Rz) of 1 μm or less (in accordance with JIS B 0601) was obtained.--;

Column 14, lines 1-12, please delete entire paragraph "An aluminum plate 2b (JIS #1100) having a thickness ... of 30 mm was formed." and insert --An aluminum plate 2b (JIS #1100) having a thickness of 0.8 mm and in the form of a drum was continuously welded by a high-frequency welder 4 at a speed of 50 to 60 m/min., as shown in Fig. 2, so that an aluminum electroseamed tube having an outer diameter of 30 mm was formed.--;

UNITED STATES PATENT AND TRADEMARK OFFICE

CERTIFICATE OF CORRECTION

PATENT NO. : 4,987,046

DATED : JANUARY 22, 1991

INVENTOR(S) : KUTAMI ET AL

It is certified that error appears in the above-identified patent and that said Letters Patent is hereby corrected as shown below:

Column 14, line 56, after "the" insert --sequential--;

Column 15, line 25, change "form" to --from--;

Column 15, line 42, change "so" to --of--;

Column 16, line 43, change "no-uniformity" to --non-uniformity--.

Signed and Sealed this

Sixth Day of October, 1992

*Attest:*

DOUGLAS B. COMER

*Attesting Officer*

*Acting Commissioner of Patents and Trademarks*